US006168338B1

(12) United States Patent
Young

(10) Patent No.: US 6,168,338 B1
(45) Date of Patent: Jan. 2, 2001

(54) WRAP AROUND NOTEBOOK

(76) Inventor: Clifford Kenneth Young, 10565 Sunshine Hill Rd., Sonora, CA (US) 95370

( * ) Notice: Under 35 U.S.C. 154(b), the term of this patent shall be extended for 0 days.

(21) Appl. No.: 09/237,624

(22) Filed: Jan. 26, 1999

(51) Int. Cl.[7] ..... B42F 3/00

(52) U.S. Cl. ..... 402/26; 402/70; 402/73; 402/76; 402/77; 281/29; 281/36

(58) Field of Search ..... 402/70, 26, 73, 402/76, 77; 281/29, 36

(56) References Cited

U.S. PATENT DOCUMENTS

| | | | | |
|---|---|---|---|---|
| 3,263,687 | * | 8/1966 | Weichert | 402/73 |
| 3,884,586 | | 5/1975 | Michaelis et al. | 402/38 |
| 5,160,208 | | 11/1992 | Lockhart | 402/24 |
| 5,503,486 | | 4/1996 | Zane | 402/72 |

* cited by examiner

*Primary Examiner*—Willmon Fridie, Jr.
*Assistant Examiner*—Mark T. Henderson

(74) *Attorney, Agent, or Firm*—Lyon & Lyon LLP

(57) ABSTRACT

A ring binder notebook is described which utilizes readily openable and closable snap rings and one or more covers that, unlike standard ring binder notebooks, are not restricted to either a closed (0°) or a half-open (180°) position—but may be fully opened (360°) back to front. This flexibility, previously possible only with standard spiral bound notebooks, is now achieved while still retaining the ability to readily add, remove, or rearrange the contents of the notebook. A notebook ring assembly is also described. The ring assembly has a shell, a pair of back plates, and one or more sets of longitudinally aligned binder ring members. Each binder ring member attached to the first back plate is transversely aligned with an opposing binder ring member attached to the second back plate. Each binder ring member attached to the first back plate is attached so that it extends away from the upper surface of the first back plate. Each binder ring member attached to the second back plate is attached so that it extends a way from the lower surface of the second back plate. The attachment of the cover or covers to the ring assembly can allow for the rotation of the ring assembly with respect to the cover or covers. Alternatively, the cover or covers, if not attached to the ring assembly, can be adapted to receive each set of binder ring members.

14 Claims, 6 Drawing Sheets

WRAP AROUND NOTEBOOK

FIELD OF THE INVENTION

The present invention relates generally to notebooks and notebook ring assemblies, and more particularly to notebooks and notebook ring assemblies that allow increased flexibility and ease of use while still permitting the review, addition, removal, and rearrangement of material retained therein.

BACKGROUND OF THE INVENTION

The majority of notebooks currently in use today can be classified into one of two general categories: (1) the standard multiple-ring binder notebook; and (2) the standard spiral notebook.

The standard multiple-ring binder notebook typically utilizes a one-piece hard cover that is foldably divided along two longitudinal axes into three sections. The two end sections are identical in height and width, and form what are conventionally referred to as the front and back of the notebook. The third section, formed between the front and the back of the notebook, is typically the same height, but is substantially narrower in width. This third section is conventionally referred to as the spine of the notebook.

The standard multiple-ring binder notebook also includes a ring assembly which retains paper or other material within the cover. The ring assembly typically comprises an elongated shell, a pair of elongated back plates (left and right), and a plurality of longitudinally aligned binder rings. Each of the binder rings is generally defined by a pair of transversely opposed mirror image binder ring members (left and right) that are capable of pivotal movement between an open position and a closed position.

The ring assembly is usually immovably secured in several distinct places to the spine so that the concave underside of the shell permanently opposes the inside surface of the spine. As a result, each left binder ring member must be mounted to the left back plate such that each left binder ring member extends outward from the upper surface of the left back plate, and each right binder ring member must be mounted to the right back plate such that each right binder ring member extends outward from the upper surface of the right back plate. In such a configuration, both the left and right binder ring members protrude from gaps or notches in the convex upper surface of the shell.

In the open position, there is a gap between the free ends of each pair of binder ring members so as to enable insertion of either the left or the right binder ring members through longitudinally aligned mounting holes adjacent to the longitudinal edge of the paper or other material to be retained within the cover. After the paper or other material has been thus mounted to either the left or right binder ring members by sliding the mounting holes over the free ends of the binder ring members, the left and right binder ring members are moved to the closed position in which the free ends of each pair of binder ring members abut to form substantially continuous loops which hold the paper or other material within the cover, but which allow the pages to be accessed for review and writing. Similarly, the paper or other material can be removed from the notebook by moving the binder ring members to the open position and sliding the paper or other material off the free ends of either the left or the right binder ring members.

This ability to selectively move the binder ring members into the open or the closed position accounts for the primary advantage of the standard multiple-ring binder notebook over other types of notebooks currently available—the ability to easily add, remove, or rearrange material contained within the notebook. Thus, such standard multiple-ring binder notebooks are capable of being continually updated or even reused.

However, this advantage is offset by significant limitations. The standard multiple-ring binder notebook does not allow the front and back, along with the contents of the notebook, to be folded back-to-back. That is, when used on a flat surface, the standard multiple-ring binder notebook occupies, at a minimum, an area equivalent to two sheets of the paper or other material retained within the notebook. This size limitation becomes critical when space is at a premium, such as in lecture halls, laboratories, or on airplanes. Furthermore, the standard multiple-ring binder notebook's inability to be folded back-to-back eliminates the user's ability to provide the additional underlying support that is often desired when writing or reading without the benefit of a hard surface such as a desk or a table. Moreover, the size and positioning of the ring assembly utilized to retain the paper or other material within the standard multiple-ring binder notebook makes it difficult to write on adjacent sheets of such paper or other material without significant shifting of the entire notebook.

In contrast to the standard multiple-ring binder notebook, the standard spiral notebook has two separate and distinct covers. These covers are typically identical in height and width, and are conventionally referred to as the front cover and the back cover of the notebook. In addition to the front and back covers, the spiral notebook includes a wire-like spine. This wire-like spine is repeatedly threaded through longitudinally aligned holes in the covers and any paper or other material contained within the notebook in a spiral pattern.

The standard spiral notebook displays two primary advantages over other types of notebooks currently available. First, the standard spiral notebook allows the front cover and the back cover, as well as any paper or other material contained within the notebook, to be folded back-to-back. As a result, the standard spiral notebook can be used on a flat surface and only occupy the space of one of the covers. Furthermore, the ability to fold the covers back-to-back provides increased underlying support for writing and reading when a hard surface, such as a desk or a table, is unavailable.

Second, the user of the standard spiral notebook is readily capable of writing on adjacent sheets of paper or other material retained within the notebook. As a result, the user need not continually shift the entire notebook after each page. It is thus easier to record more information within a single notebook—thereby eliminating storage space for unnecessary notebooks and reducing the total number of notebooks that need to be purchased.

However, these advantages are also offset by significant limitations. Because the covers of the standard spiral notebook, and the material contained therebetween, are retained by a continuous wire-like spine, the standard spiral notebook does not allow for the addition, removal, replacement, or rearrangement of paper or other material within the notebook. Thus, the spiral notebook cannot be updated, modified, or reused.

Various other notebooks and notebook ring assemblies also exist (e.g., the stapled or stitched, permanently bound, notebook). However, like the standard multiple-ring binder notebook and the standard spiral notebook, none of these other notebooks combine all of the above-noted advantages: (1) the easy addition, removal, replacement, and rearrangement of material; (2) the ability to be folded back-to-back into a compact shape which also provides increased underlying support; and (3) the freedom to easily write on adjacent pieces of material contained within the notebook without undue manipulation. Similarly, none of the other notebook ring assemblies effectively facilitate a notebook that combines all of the above-noted advantages.

SUMMARY OF THE INVENTION

It is therefore an object of the present invention to provide an improved notebook and notebook ring assembly that either combines or facilitates all of the above-noted advantages.

The notebook ring assembly of the present invention comprises a shell, a pair of back plates, and one or more sets of longitudinally aligned binder ring members. Each binder ring member mounted or attached to the first back plate is transversely aligned with an opposing binder ring member mounted or attached to the second back plate. Each binder ring member mounted or attached to the first back plate is mounted or attached so that it extends away from the upper surface of the first back plate. Each binder ring member mounted or attached to the second back plate is mounted or attached so that it extends away from the lower surface of the second back plate. When the back plates are bowed outwardly from the shell, each set of opposing binder ring members forms a substantially closed loop for retaining paper or other material within the notebook. Conversely, when the back plates are bowed inwardly toward the shell, the free ends of each set of binder ring members are spread apart to permit insertion or removal of paper or other material.

The notebook of the present invention comprises the notebook ring assembly of the present invention and one or more covers. The cover or covers can be attached to the notebook ring assembly. This attachment can be fixed or can allow for rotation of the ring assembly with respect to the cover or covers. Alternatively, the cover or covers, if not attached to the notebook ring assembly, can be adapted to receive each set of binder ring members.

Other aspects, objects, features, and advantages of the present invention will become apparent to those skilled in the art upon reading the detailed description of the preferred embodiments in conjunction with the accompanying drawing and appended claims.

DETAILED DESCRIPTION OF THE PREFERRED EMBODIMENTS

Figure 1:
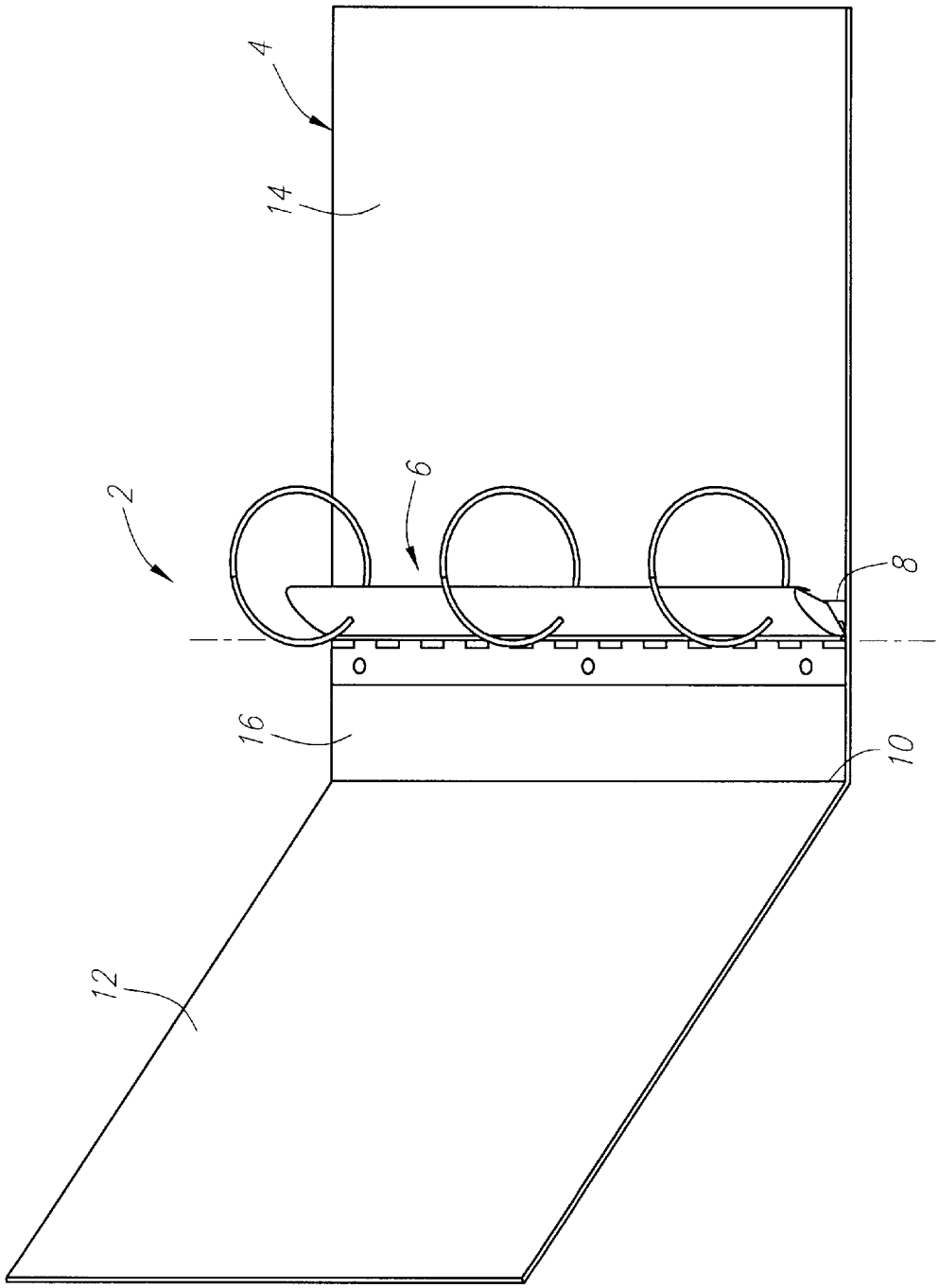
FIG. 1 is a perspective view of one preferred embodiment of the invention.

Referring initially to FIG. 1, therein is illustrated a first preferred embodiment of the improved notebook and notebook ring assembly of the present invention. The notebook 2 includes a cover 4 and a ring assembly 6. The cover 4 is flexibly divided along two longitudinal axes 8 & 10 to form a top 12, a bottom 14, and a spine 16. Preferably, the cover 4 is a continuous piece of material that is slightly puckered along the longitudinal axes 8 & 10 to promote ease of movement. Alternatively, the cover 4 can be formed from three distinct pieces of material which are mechanically hinged. The top and bottom 12 & 14 are substantially identical in height and width and are preferably slightly larger than the paper or other material to be contained within the notebook. The spine 16, which is adjacent to both the top and bottom 12 & 14, is the same height, but is substantially narrower in width. The cover 4 is preferably made of a semi-rigid material such as cardboard or plastic with a vinyl covering. Alternatively, the cover 4 can be constructed of a lightweight metal.

Figure 2:
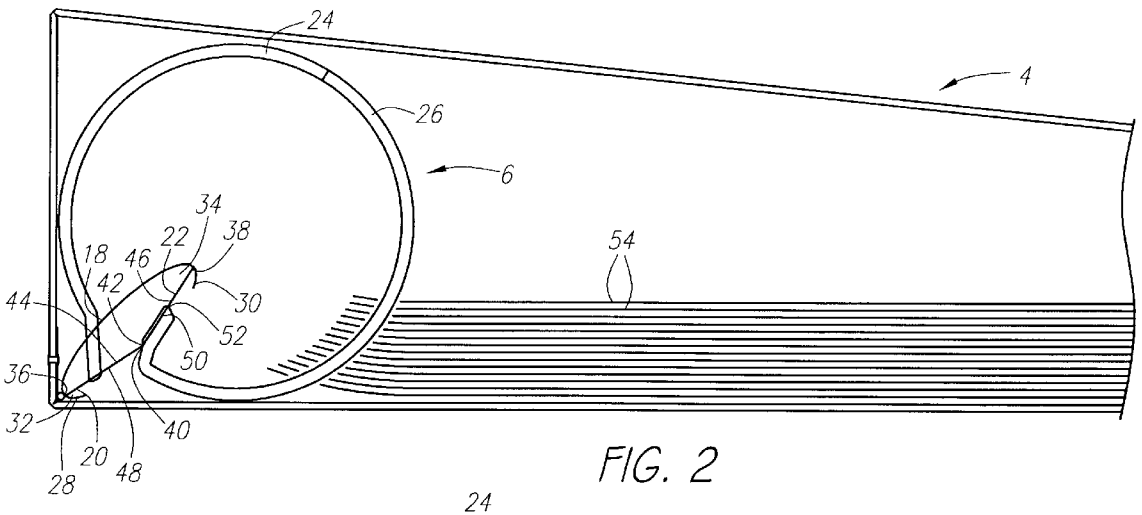
FIG. 2 is a side view of one preferred embodiment of the invention with the cover in its closed position and the binder ring members in their closed positions.

Referring now to FIG. 2, the ring assembly 6 includes a shell 18, a pair of mirror image back plates 20 & 22, and one or more longitudinally aligned sets of transversely aligned opposing binder ring members 24 & 26. Although the ring assembly 6 is preferably an elongated single unit, the ring assembly can be separated into a plurality of distinct units, each having its own shell, back plates, and one or more sets of opposing binder ring members. The shell 18 is preferably made of a resilient, spring-like metal. The back plates 20 & 22 are preferably made of a relatively stiff metal or other suitable semi-rigid material. The opposing binder ring members 24 & 26 are preferably made of a stiff metal, and can be fashioned from a variety of shapes, although a substantially semi-circular shape is preferred.

The shell 18 has a generally arched cross section configuration with its marginal longitudinal edges 28 & 30 being curled under or down to form elongated hinge pockets 32 & 34. Each pocket so formed receives the outer longitudinal edge 36 & 38 of one of the back plates 20 & 22 and generally defines the pivot axis for that back plate. The inner longitudinal edges of the back plates 40 & 42 abut or interlock each other along their entire length. In one particularly preferred embodiment, one of the marginal longitudinal edges 28 is slotted, with only the alternating slots curled under or down in order to facilitate attachment of the ring assembly to the spine, as described below.

Each binder ring member 24 mounted to or attached to the first back plate 20 is transversely aligned with a corresponding binder ring member 26 mounted to or attached to the second back plate 22. Each binder ring member 24 mounted or attached to the first back plate 20 is mounted or attached so that it extends away from the upper surface 44 of the first back plate 20. Each binder ring member 24 mounted or attached to the first back plate 20 is preferably mounted or attached equidistant from the outer 36 and inner 40 longitudinal edges of the first back plate 20. Furthermore, each binder ring member 24 mounted or attached to the first back plate 20 is preferably slightly bent toward the inner longitudinal edge 40 of the first back plate 20 before assuming a substantially semicircular shape.

Conversely, each binder ring member 26 mounted or attached to the second back plate 22 is mounted or attached so that it extends away from the lower surface 50 of the second back plate 22. Each binder ring member 26 mounted or attached to the second back plate 22 is preferably mounted or attached between the center 52 and inner longitudinal edge 42 of the second back plate 22. Furthermore, each binder ring member 26 mounted or attached to the second back plate 22 is preferably substantially bent toward the inner longitudinal edge 42 of the second back plate 22 before assuming a substantially semicircular shape.

The binder ring members 24 & 26 are preferably mounted or attached to the back plates 20 & 22 by spot welding or swedging. Alternatively, the binder ring members 24 & 26 can be stamped elongated extensions of the back plates themselves.

The back plates are movable between two positions. One such position is best depicted in FIG. 2, wherein it is seen that back plates 20 & 22 are bowed outwardly away from the shell 18 with their upper surfaces 44 & 46 facing toward each other and their lower surfaces 48 & 50 facing away from each other. In this position, each set of opposing binder ring members 24 & 26 forms a substantially closed loop for retaining paper or other material 54 appropriately punched with holes to accept the binder ring members 24 & 26.

Figure 3:
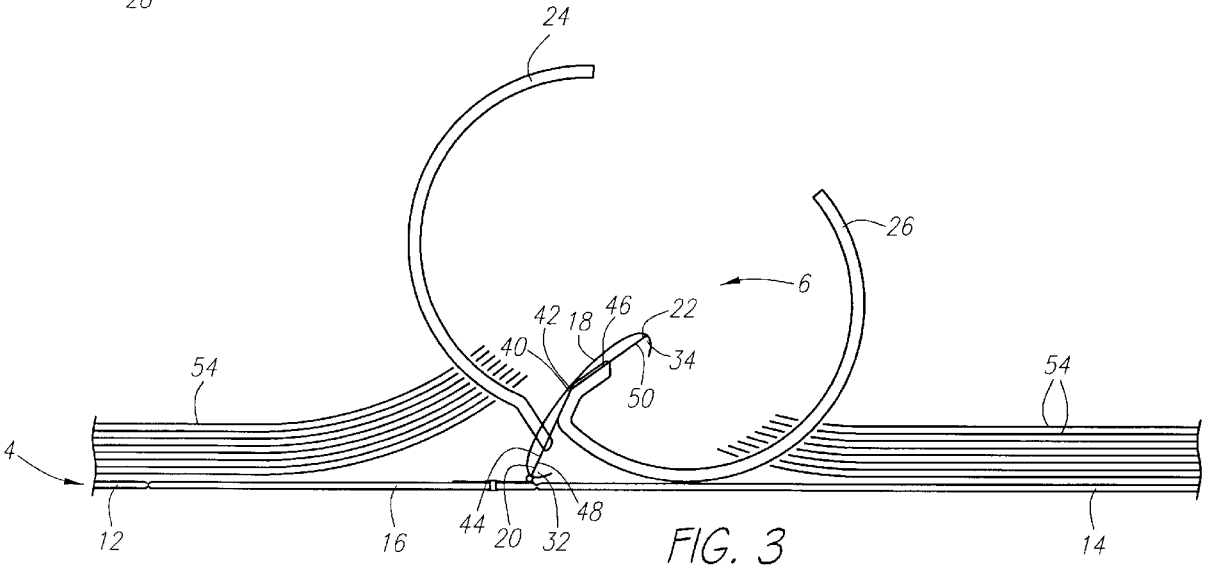
FIG. 3 is a side view of one preferred embodiment of the invention with the cover in its half-open position and the binder ring members in their open positions.

The second position is depicted in FIG. 3. In this position, the back plates 20 & 22 are bowed inwardly toward the shell 18 with their upper surfaces 44 & 46 facing away from each other and their lower surfaces 48 & 50 facing toward each other. In this position, the free ends of each set of opposing binder ring members 24 & 26 are spread apart to permit insertion or removal of material 54 from the binder ring members 24 & 26.

The combined width of the back plates 20 & 22 is slightly greater than the distance between the longitudinal pivot axes defined by the hinge pockets 32 & 34. Movement between the inwardly and outwardly bowed positions occurs without causing disengagement of the inner edges 40 & 42 of the back plates 20 & 22. That is, the inner edges 40 & 42 of the back plates 20 & 22 abut or interlock each other at all angular positions. The back plates 20 & 22 are first moved, say, from the outwardly bowed position with an included angle less than 180 degrees, as depicted in FIG. 2, into a position at which they are disposed in substantially a coplanar relationship, the shell 18 flexing or distorting somewhat at that position to accommodate the back plates 20 & 22 as they travel through their coplanar position. The back plates 20 & 22 then continue into the inwardly bowed position with an included angle greater than 180 degrees, as depicted in FIG. 3, by snap action as the pressure existing at the coplanar position is relieved and the shell 18 naturally unflexes into a semi-relaxed state. The same motion characteristics occur in moving the back plates 20 & 22 in the reverse direction from the inwardly bowed position to the outwardly bowed position.

Figure 4:
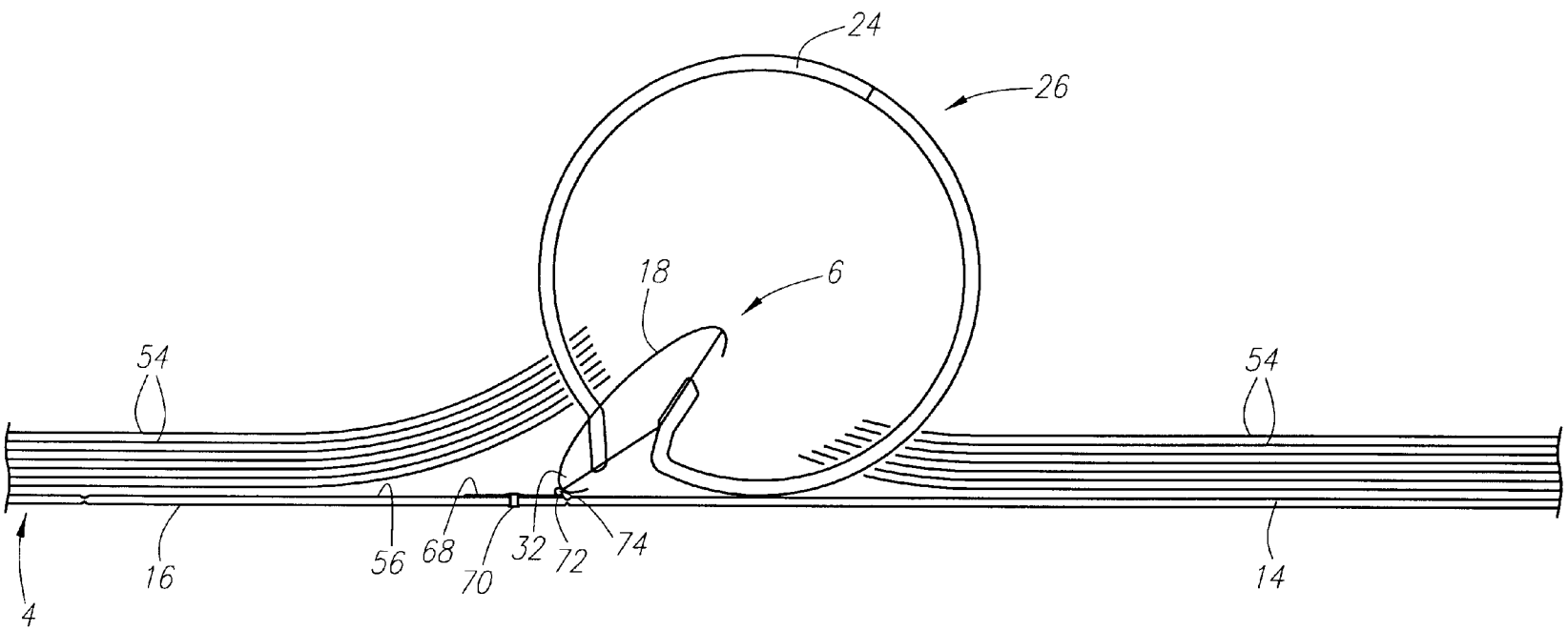
FIG. 4 is a side view of one preferred embodiment of the invention with the cover in its half-open position and the binder ring members in their closed positions.
Figure 5:
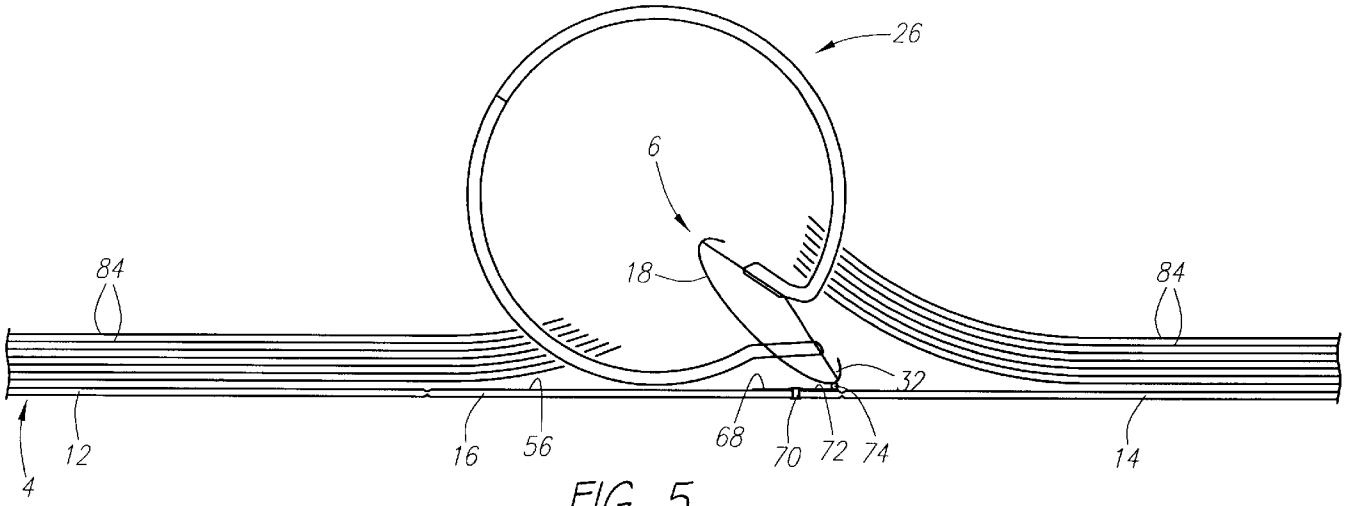
FIG. 5 is another side view of one preferred embodiment of the invention with the cover in its half-open position and the binder ring members in their closed positions.

Referring now to FIGS. 4–5, the ring assembly 6 is rotatively attached to the inner surface 56 of the spine 16. This rotative attachment is preferably accomplished by way of a hinged connection. A flange 68 is attached to the inner surface 56 of the spine 16 by two or more longitudinally aligned rivets 70. In a particularly preferred embodiment, one longitudinal end 72 of the flange 68 is slotted, with only the alternating slots curled over or up, in order to mate with the alternating slots in the shell 18, as described above. A longitudinal hinge pin 74 is fitted through the curled slots of the flange 68 and the shell 18, thereby securing the shell 18 to the flange 68. Alternatively, a second flange with alternating curled slots for mating with the alternating slots in the shell 18 may be attached to the outer surface of the shell 18 by cement or spot welds in lieu of slotting one of the marginal longitudinal edges 28 of the shell 18 as described above. In either configuration, the ring assembly 6 is capable of rotating about the longitudinal axis defined by the longitudinal hinge pin 74.

Referring back to FIG. 2, the first preferred embodiment of the present invention is illustrated with both the cover 4 and the opposing binder ring members 24 & 26 in their closed positions. In such a configuration, the back plates 20 & 22 are bowed outwardly of the shell 18, resulting in each set of binder ring members 24 & 26 forming a substantially closed loop for retaining material appropriately punched with holes 54 to accept each set of binder ring members 24 & 26 within the notebook.

Referring back to FIG. 3, the first preferred embodiment of the present invention is illustrated with the cover 4 half way open for use on a flat surface, and the opposing binder ring members 24 & 26 in their open positions. In such a configuration, the back plates 20 & 22 are bowed inwardly of the shell 18, resulting in the free ends of the opposing binder ring members 24 & 26 being spread apart to permit insertion or removal of paper or other material from the binder ring members by sliding such paper or other material off one of the free ends. Also in such a configuration, the top 12, bottom 14, and spine 16 of the cover 4 are all coplanar.

Referring back to FIG. 4, the first preferred embodiment of the present invention is illustrated with the cover 4 half way open and the ring assembly 6 positioned so as to facilitate the use of the paper or other material retained on the bottom half (right side) of the notebook. In such a configuration, the ring assembly 6 is rotated about the axis defined by the longitudinal hinge pin 74 so that the convex face of the shell 18 is facing away from the bottom 14 of cover 4.

Referring back to FIG. 5, the first preferred embodiment of the present invention is illustrated with the cover 4 half way open and the ring assembly 6 positioned so as to facilitate the use of paper or other material retained on the top half (left side) of the notebook. In such a configuration, the ring assembly 6 is rotated about the axis defined by the longitudinal hinge pin 74 so that the convex face of the shell 18 is facing toward the top 12 of cover 4.

Figure 6:
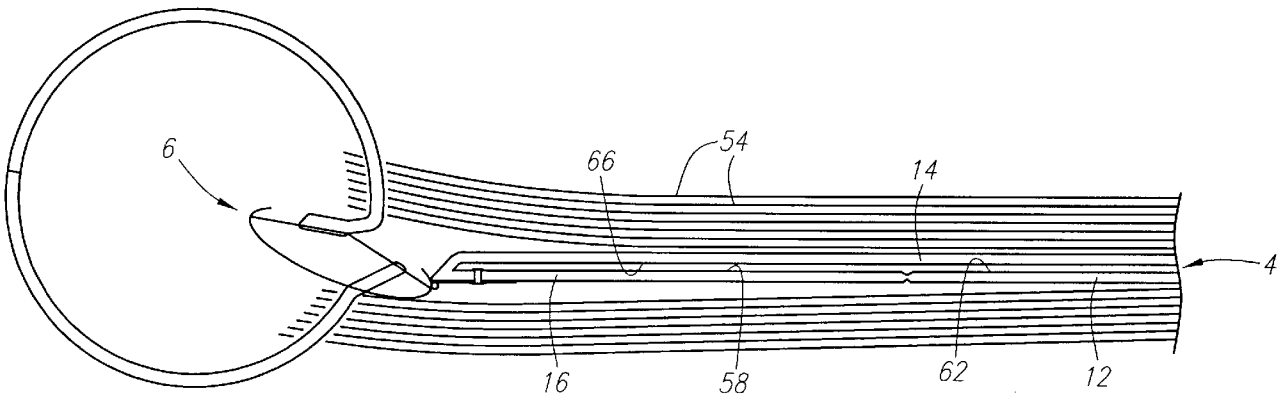
FIG. 6 is a side view of one preferred embodiment of the invention with the cover in its fully open position and the binder ring members in their closed positions.

Referring now to FIG. 6, the first preferred embodiment of the present invention is illustrated with the cover 4 in a fully open position. In such a configuration, the outer surface 66 of the bottom 14 is adjacent to the outer surface 62 of the top 12 and the outer surface 58 of the spine 16. Also, in such a configuration, the ring assembly 6 is rotated so that the transverse axis of the shell 18 is substantially coplanar with the top 12, the bottom 14, and the spine 16.

Figure 7:
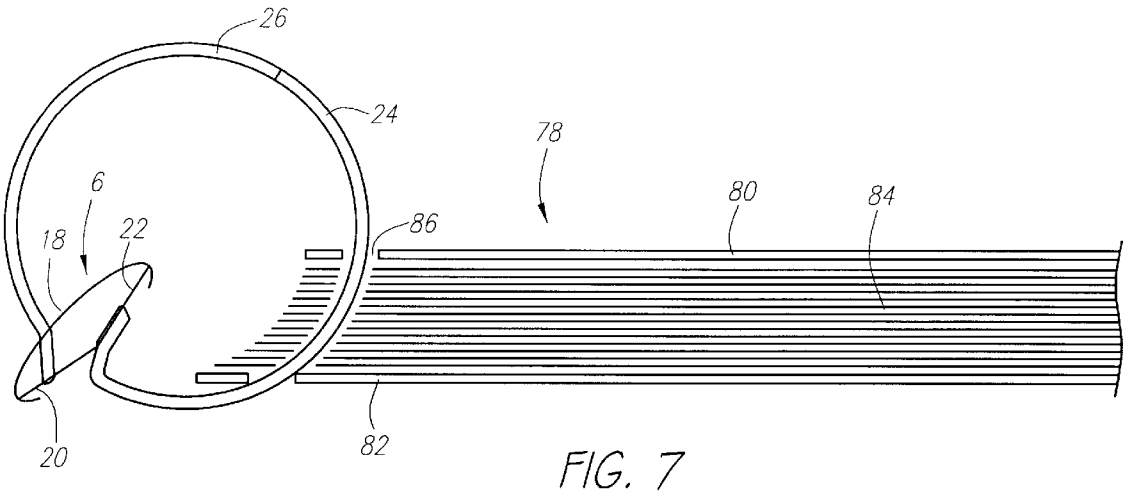
FIG. 7 is a side view of a second preferred embodiment of the invention with the covers in their closed positions and the binder ring members in their closed positions.

Referring now to FIG. 7, therein is illustrated a second preferred embodiment of the improved notebook of the present invention. The notebook 78 includes a top cover 80, a bottom cover 82, and a ring assembly 6. The top and bottom covers 80 & 82 are identical in height and width and are preferably the same dimensions as the paper or other material 84 to be retained within the notebook 78. The top and bottom covers 80 & 82 are also appropriately punched with longitudinally aligned holes 86 to accept each set of opposing binder ring members 24 & 26. The ring assembly 6 is identical to that described with respect to the first preferred embodiment, with the exception of any modifications designed to facilitate the attachment of the ring assembly to a cover. Other than being adapted to receive each pair of opposing binder ring members 24 & 26, the ring assembly 6 is not fixably attached to either cover 80 & 82.

FIG. 7 shows the second preferred embodiment of the present invention with the covers 80 & 82 and the opposing binder ring members 24 & 26 in their closed positions. In such a configuration, the back plates 20 & 22 are bowed slightly outwardly of the shell 18, resulting in the binder ring members 24 & 26 forming a substantially closed loop for retaining material appropriately punched with longitudinally aligned holes 86 to accept each set of opposing binder ring members 24 & 26.

Figure 8:
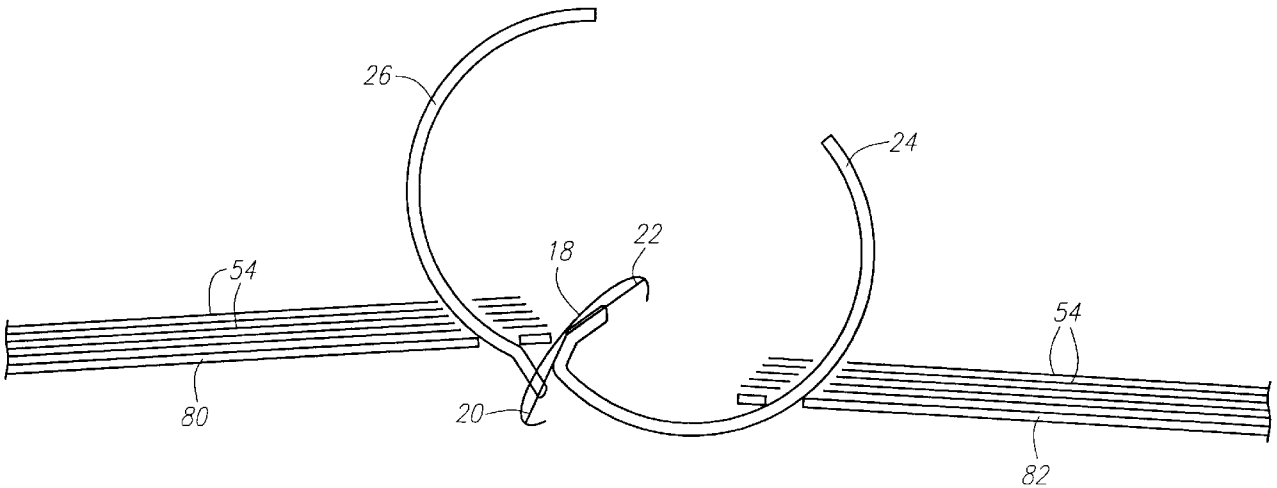
FIG. 8 is a side view of a second preferred embodiment of the invention with the covers in their half-open positions and the binder ring members in their open positions.

Referring now to FIG. 8, the second preferred embodiment of the present invention is shown with the covers 80 & 82 approximately half way open and the opposing binder ring members 24 & 26 in their open positions. In such a configuration, the back plates 20 & 22 are bowed slightly inwardly of shell 18, resulting in the free ends of the binder ring members 24 & 26 being spread apart to permit insertion or removal of material from the notebook. Also, in such a configuration, the top cover 80 and bottom cover 82 are proximately coplanar. Thus, material on both sides of the notebook can be simultaneously accessed by the user while the notebook is placed on a flat surface.

Figure 9:
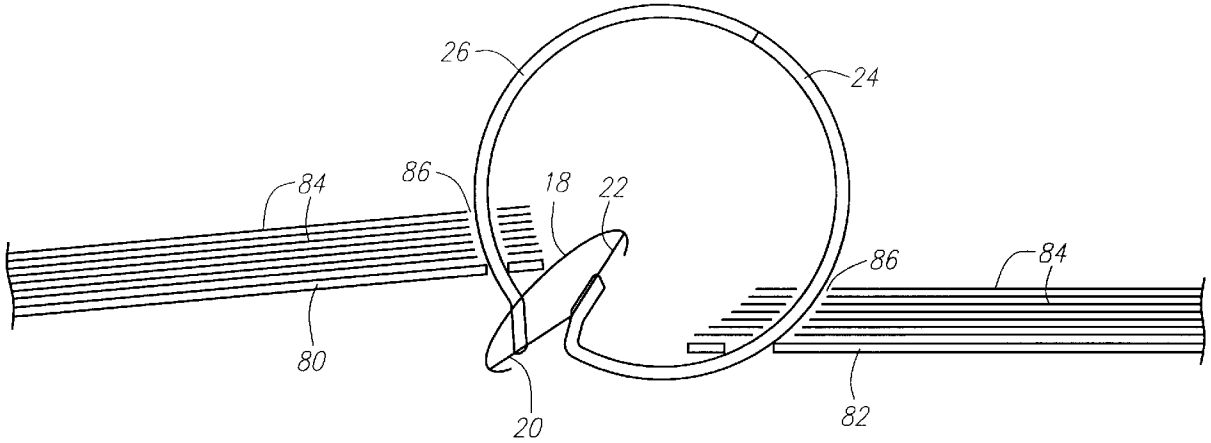
FIG. 9 is a side view of a second preferred embodiment of the invention with the covers in their half-open positions and the binder ring members in their closed positions.

Referring now to FIG. 9, the second preferred embodiment of the present invention is shown with the covers 80 & 82 approximately half way open and the opposing binder ring members 24 & 26 in their closed positions. As was the case with respect to FIG. 7, the back plates 20 & 22 are bowed slightly outwardly of the shell 18, resulting in the binder ring members 24 & 26 forming a substantially closed loop for retaining material 84 appropriately punched with longitudinally aligned holes 86 to accept each set of opposing binder ring members 24 & 26. Also, as was the case with respect to FIG. 8, the top cover 80 and bottom cover 82 are proximally coplanar. Thus, material on both sides of the notebook can be simultaneously accessed by the user while the notebook is placed on a flat surface.

Figure 10:
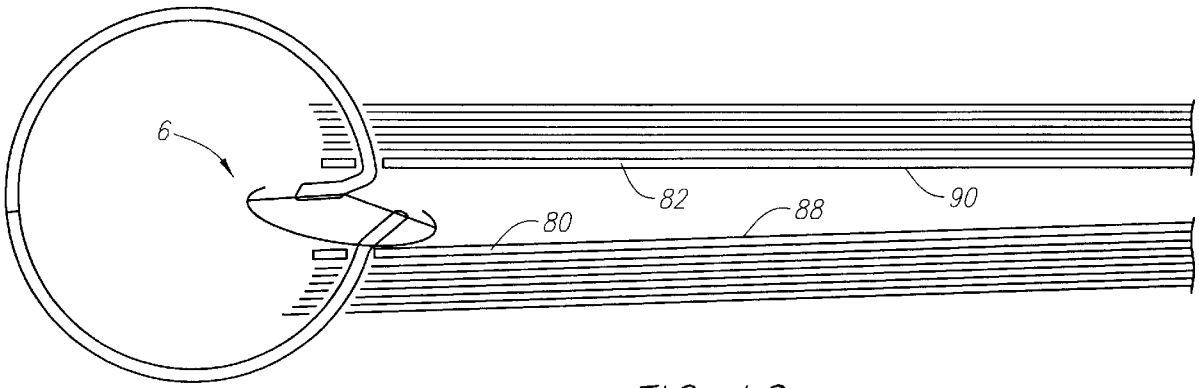
FIG. 10 is a side view of a second preferred embodiment of the invention with the covers in their fully open positions and the binder ring members in their closed positions.

Finally, referring to FIG. 10, the second preferred embodiment of the present invention is shown with the covers 80 & 82 in their fully open position. In such a configuration, the outer surface 88 of the top cover 80 is substantially adjacent to the outer surface 90 of the bottom cover 82. Also, in such a configuration, the ring assembly 6 is positioned so that it is between the outer surface 88 of the top cover 80 and the outer surface 90 of the bottom cover 82.

As should be apparent from the foregoing specification, the invention is susceptible to being modified with various alterations and modifications that may differ from those which have been described in the preceding specification and description. Accordingly, the following claims are intended to cover all alterations and modifications which do not depart from the spirit and scope of the invention.

What is claimed is:

1. A notebook, comprising:

a cover; and a ring assembly, rotatably attached to said cover, the ring assembly including:

a first back plate, having an upper surface, a lower surface, an inner edge, and an outer edge;

a second back plate, having an upper surface, a lower surface, an inner edge, and an outer edge, wherein the inner edge of said second back plate abuts the inner edge of said first back plate, the upper surface of said first back plate is adjacent to the upper surface of said second back plate, and the lower surface of said first back plate is adjacent to the lower surface of said second back plate;

a first binder ring member, having a free end and a fixed end, said first binder ring member being fixably attached to said first back plate and extending away from the upper surface of said first back plate;

a second binder ring member, having a free end and a fixed end, said second binder ring member being fixably attached to said second back plate and extending away from the lower surface of said second back plate; and a shell, said shell being adjacent to the outer edges of said first and second back plates.

2. The notebook of claim 1, wherein said ring assembly is rotatably attached to said cover by a hinge.

3. The notebook of claim 1, wherein the included angle between the upper surface of said first back plate and the upper surface of said second back plate is less than 180 degrees when the free end of said first binder ring member and the free end of said second binder ring member contact each other.

4. The notebook of claim 1, wherein an included angle between the upper surface of said first back plate and the upper surface of said second back plate is greater than 180 degrees when said second binder ring member contacts either the lower surface of said first back plate or the fixed end of said first binder ring member.

5. The notebook of claim 1, wherein said cover is divided into a plurality of sections.

6. The notebook of claim 1, wherein said second binder ring member is substantially semi-circular in shape.

7. The notebook of claim 1, wherein said cover is not adapted to permit movement of said second binder ring member.

8. The notebook of claim 5, wherein said cover is divided into a top, a bottom, and a spine, said spine being adjacent to said top and said bottom.

9. The notebook of claim 8, wherein said ring assembly is rotatably attached to said spine.

10. A notebook ring assembly, comprising:

a first back plate, having an upper surface, a lower surface, an inner edge, and an outer edge;

a second back plate, having an upper surface, a lower surface, an inner edge, and an outer edge, wherein the inner edge of said second back plate abuts the inner edge of said first back plate, the upper surface of said first back plate is adjacent to the upper surface of said second back plate, and the lower surface of said first back plate is adjacent to the lower surface of said second back plate;

a first binder ring member, having a free end and a fixed end, said first binder ring member being fixably attached to said first back plate and extending away from the upper surface of said first back plate;

a second binder ring member, having a free end and a fixed end, said second binder ring member being fixably attached to said second back plate and extending away from the lower surface of said second back plate; and a shell, said shell being adjacent to the outer edges of said first and second back plates;

wherein an included angle between the upper surface of said first back plate and the upper surface of said second back plate is greater than 180 degrees when said second binder ring member contacts either the lower surface of said first back plate or the fixed end of said first binder ring member.

11. The notebook ring assembly of claim 10, wherein said ring assembly is attached to a cover.

12. A notebook, comprising:

a first back plate, having an upper surface, a lower surface, an inner edge, and an outer edge;

a second back plate, having an upper surface, a lower surface, an inner edge, and an outer edge, wherein the inner edge of said second back plate abuts the inner edge of said first back plate, the upper surface of said first back plate is adjacent to the upper surface of said second back plate, and the lower surface of said first back plate is adjacent to the lower surface of said second back plate;

a first binder ring member, having a free end and a fixed end, said first binder ring member being fixably attached to said first back plate and extending away from the upper surface of said first back plate;

a second binder ring member, having a free end and a fixed end, said second binder ring member being fixably attached to said second back plate and extending away from the lower surface of said second back plate;

a shell, said shell being adjacent to the outer edges of said first and second back plates, thereby forming a ring assembly with said first back plate, said second back plate, said first binder ring member, and said second binder ring member;

a first cover, adapted to receive the free end of said first binder ring member; and a second cover, adapted to receive the free end of said second binder ring member.

13. The notebook of claim 12, wherein said shell is independent of said first cover and said second cover.

14. The notebook of claim 12, wherein said second binder ring member is substantially semi-circular in shape.

* * * * *